US008037723B2

(12) United States Patent
Fong

(10) Patent No.: US 8,037,723 B2
(45) Date of Patent: Oct. 18, 2011

(54) THEFT PREVENTION DEVICE

(75) Inventor: Gary M. Fong, Seattle, WA (US)

(73) Assignee: Gary Fong, Inc., Seattle, WA (US)

( * ) Notice: Subject to any disclaimer, the term of this patent is extended or adjusted under 35 U.S.C. 154(b) by 0 days.

(21) Appl. No.: 12/709,363

(22) Filed: Feb. 19, 2010

(65) Prior Publication Data

US 2011/0203329 A1 Aug. 25, 2011

(51) Int. Cl.
*E05B 69/00* (2006.01)

(52) U.S. Cl. ..... 70/58; 70/14; 70/232; 24/633

(58) Field of Classification Search ..... 70/14, 54–56, 70/58, 63, 232; 24/633, 573.1, 116 R
See application file for complete search history.

(56) References Cited

U.S. PATENT DOCUMENTS 4,407,146 A * 10/1983 Nielsen, Jr. ..... 70/232
4,674,303 A * 6/1987 Salcone, II ..... 70/63
4,731,912 A * 3/1988 Boriskie et al. ..... 24/633
4,878,277 A * 11/1989 Portuese ..... 24/633
4,987,662 A * 1/1991 Haffey et al. ..... 24/633
5,129,129 A * 7/1992 Collins et al. ..... 24/633
5,189,767 A * 3/1993 Reitsma ..... 24/633
5,228,584 A * 7/1993 Williams, Jr. ..... 220/3.8
5,307,544 A * 5/1994 Quarberg et al. ..... 24/633
5,605,466 A * 2/1997 Devlin et al. ..... 439/144
D396,736 S * 8/1998 Davis ..... D2/639
6,519,208 B2 * 2/2003 DeVries ..... 368/10
6,730,845 B1 * 5/2004 Criniti et al. ..... 174/67
6,806,426 B1 * 10/2004 Gretz ..... 174/67
6,988,297 B2 * 1/2006 Willard et al. ..... 24/633
2007/0101558 A1 * 5/2007 Marinkovic ..... 24/633

* cited by examiner

*Primary Examiner* — Suzanne Barrett
(74) *Attorney, Agent, or Firm* — Christie, Parker & Hale, LLP

(57) ABSTRACT

A theft prevention device includes an outer shell having a top wall and side walls and defining a cavity, wherein the side walls have a slit therein adapted to accommodate a strap and wherein the top wall has an outer shell opening; and an inner shell having a top wall and side walls and defining a cavity, wherein the side walls have a slit therein adapted to accommodate a strap and wherein the top wall has an inner shell opening; wherein the inner shell is adapted to be mated to the outer shell such that the inner shell opening and the outer shell opening can be generally aligned.

9 Claims, 5 Drawing Sheets

THEFT PREVENTION DEVICE

FIELD

Embodiments of the present invention generally related to a theft prevention device, and more particularly, to a theft prevention device attachable to a strap having a buckle.

BACKGROUND

Luggage, carrying bags, backpacks and various other storage devices often use a snap buckle as a way to temporary "lock" the storage device closed, thereby preventing the contents stored therein from spilling out. Often, snap buckles are used instead of other fasteners, such as zippers, because they are easy to couple and uncouple. Strap buckles are manufactured in various sizes and usually involve a female portion and a male portion adapted to "snap" together in a locking position. Typically, the male portion will have a pair of movable fingers that are biased into an open position. The fingers can be forced into a closed position to allow the male portion to be inserted into the female portion and then release to engage the female portion and thereby couple the portions together. The portions can be released from each other relatively easily by applying a force to the fingers to move them into the closed position and sliding the male portion out of the female portion. Accordingly, while snap buckles provide an easy mechanism for temporarily locking together two pieces of fabric or other material, since snap buckles cannot be locked in and of themselves, they do not prevent unwanted persons from unsnapping the buckle and stealing the contents within the storage device.

SUMMARY

According to one embodiment of the present invention, a theft prevention device is provided including an outer shell having a top wall and side walls and defining a cavity, wherein the side walls have a slit therein adapted to accommodate a strap and wherein the top wall has an outer shell opening; and an inner shell having a top wall and side walls and defining a cavity, wherein the side walls have a slit therein adapted to accommodate a strap and wherein the top wall has an inner shell opening; wherein the inner shell is adapted to be mated to the outer shell such that the inner shell opening and the outer shell opening can be generally aligned.

In one embodiment, the top walls of the outer shell and of the inner shell define a ledge which protrudes past an end of the side walls of the outer shell and of the inner shell, respectively, and wherein the outer shell opening and the inner shell opening are located on the ledge of the outer shell and the inner shell, respectively. Further, when the inner shell is mated with the outer shell, the slits on the inner shell and the outer shell overlap and are substantially aligned. In one embodiment, when the inner shell is mated with the outer shell, the theft prevention device defines a space therein adapted to accommodate a buckle attached to a strap.

In one embodiment, the theft prevention device may include a lock, wherein when the inner shell is mated with the outer shell and when the lock is inserted through the inner shell opening and the outer shell opening, the inner shell is prevented from being separated from the outer shell.

DETAILED DESCRIPTION

Figure 1:
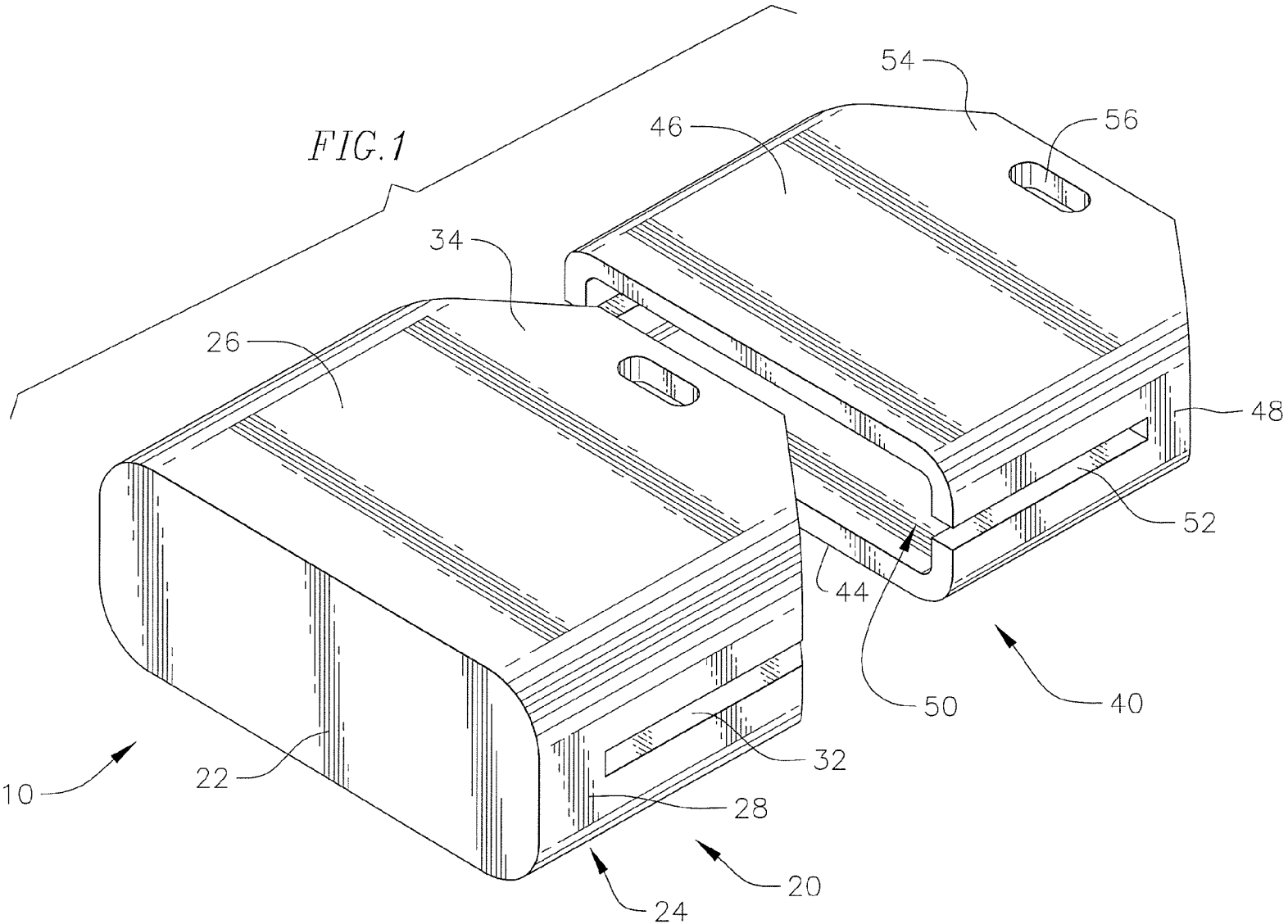
FIG. 1 is a rear perspective view of an embodiment of an uncoupled theft prevention device of the present invention.
Figure 2:
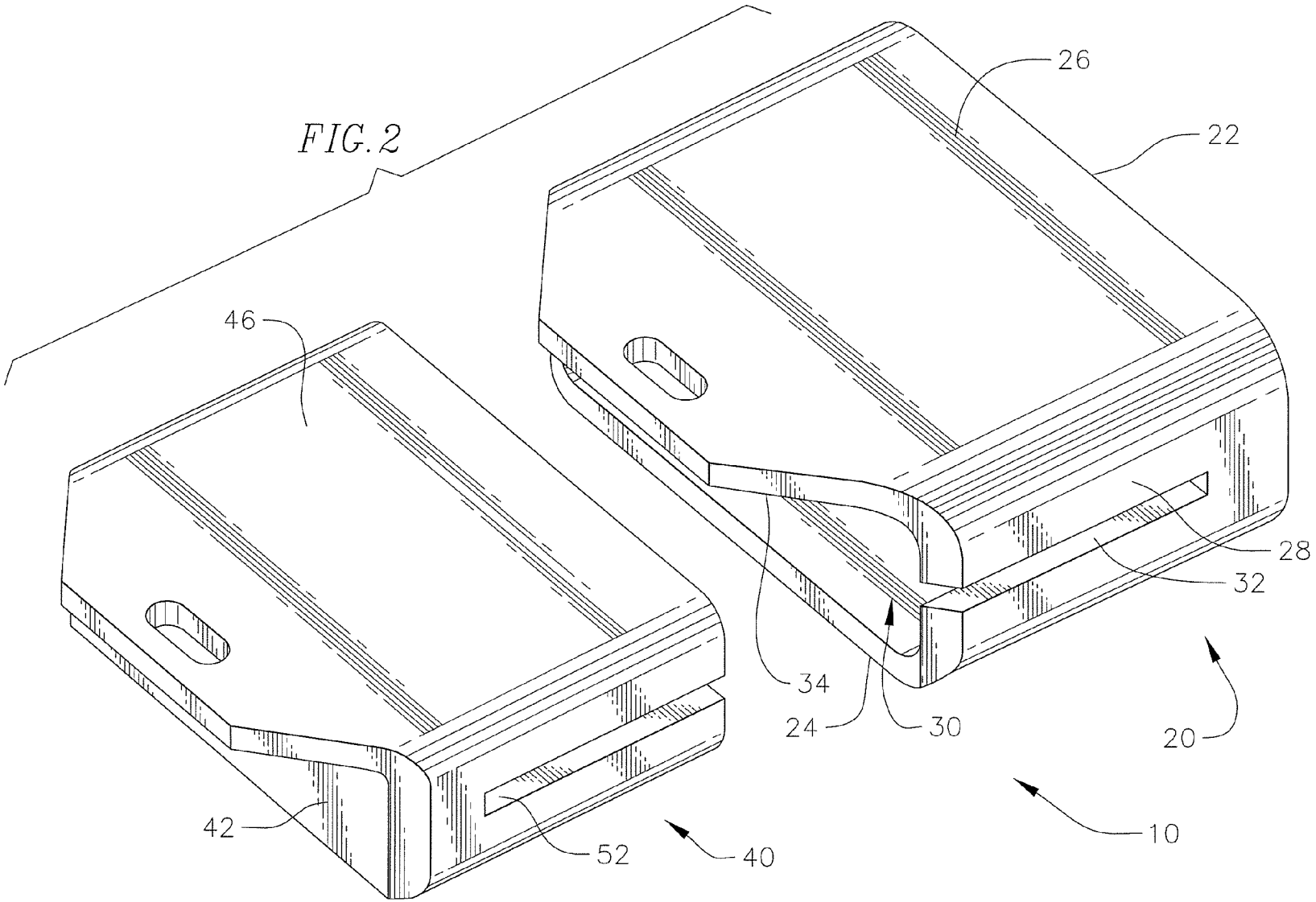
FIG. 2 is a front perspective view of an embodiment of the theft prevention device of FIG. 1.
Figure 3:
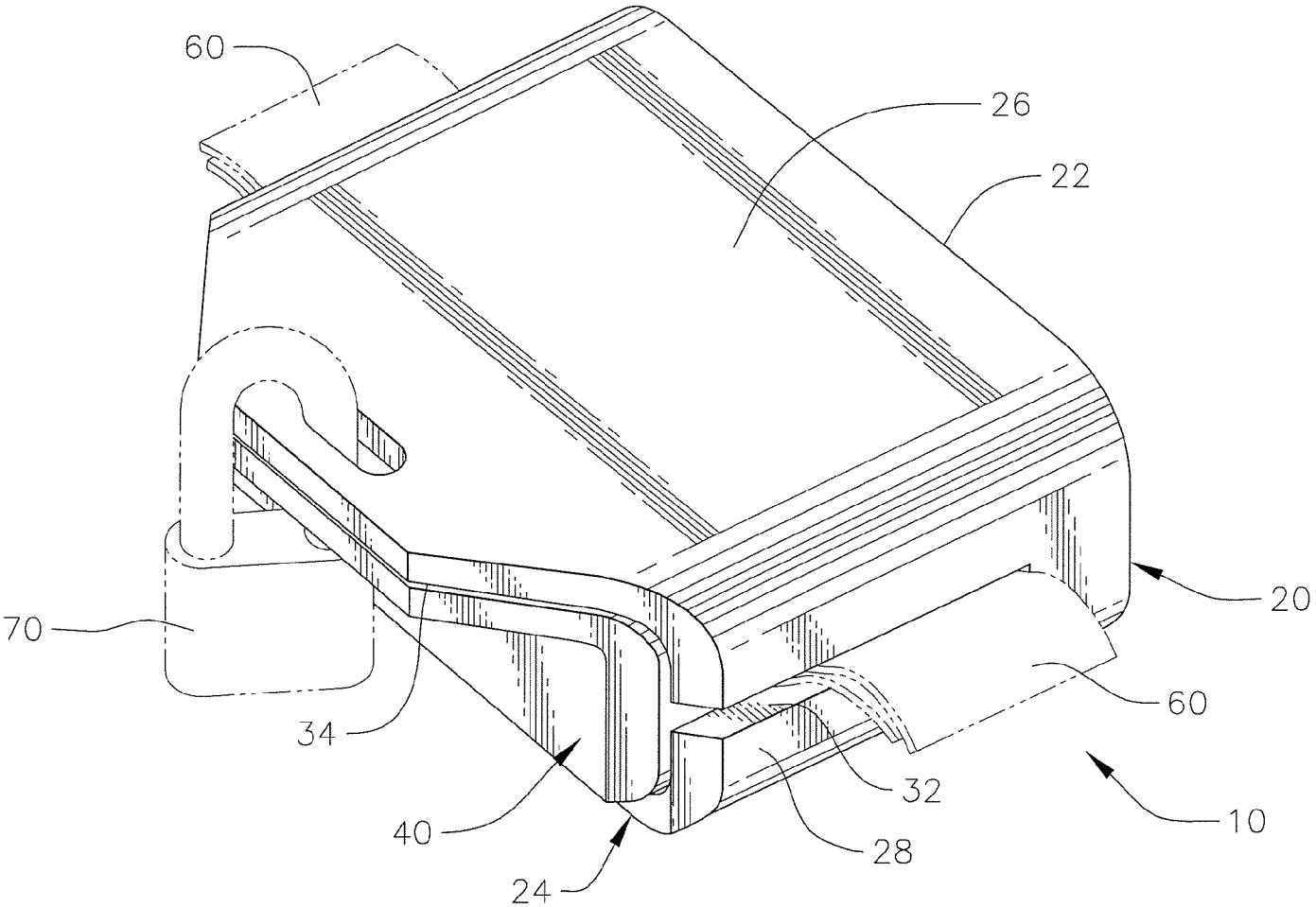
FIG. 3 is a front perspective view of the theft prevention device of FIG. 1 that has been coupled and locked.

In general, a theft prevention device 10 is provided to be attached over a buckle portion of a bag strap, such as a camera bag strap, to prevent undesired uncoupling of the buckle, and thereby prevent theft of any contents inside the bag. As will be appreciated, the theft prevention device can be attached over any coupling mechanism on a strap to prevent access to the coupling mechanism, and is not intended to be limited to buckles.

With reference now to FIGS. 1-5, the theft prevention device 10 includes an outer shell 20 and inner shell 40 adapted to mate with the outer shell. When the outer shell 20 and the inner shell 40 are mated together over a buckle and locked, they encompass the buckle and prevent access to the buckle. As such, the theft prevention device 10 can be used to safely keep contents within a storage device sealed by a buckle.

In one embodiment, the outer shell 20 is a single integral component comprising a rigid resin polymer or metal. In one embodiment, the outer shell may be made from acrylonitrile butadiene styrene (ABS), but is not limited thereto and can be made from any appropriately rigid material. The outer shell 20 is defined by an end wall 22, a bottom wall 24, a top wall 26 and side walls 28. As defined herein, "top" and "bottom" are orientations or directions as shown in the figures, with the "top" being closer to a top of the page and the "bottom" being closer to the bottom of the page. Together, the walls 22, 24, 26, 28 define an outer shell cavity 30 adapted to receive the inner shell 40 and dimensioned to cover a buckle of a strap. As will be appreciated, the size of the outer shell 20, as well as other parts of the theft prevention device 10, may be dimensioned to fit over differently sized buckles, depending on the desired use. As shown in the drawings, the outer shell is a single integral structure, but it will be appreciated that the outer shell 20 may also be made from separate pieces that are attached together, such as by welding or by fasteners.

Each of the side walls 28 includes a slit 32 sized to allow a strap 60 to pass therethrough when the theft prevention device covers a buckle. As will be appreciated, the slit 32 is wide enough to allow the strap 60 to pass therethrough, but not so wide as to allow access to the buckle such that the buckle could be uncoupled. The slit 32 has an open end at the tellnination of the side wall 28 opposite the end wall 22 to allow the strap to be inserted into the slit. Additionally, the slit 32 does not extend along the entire length of the side wall 28, thereby preventing the outer shell 20 from being able to slide off a lateral edge of the strap 60.

Figure 4:
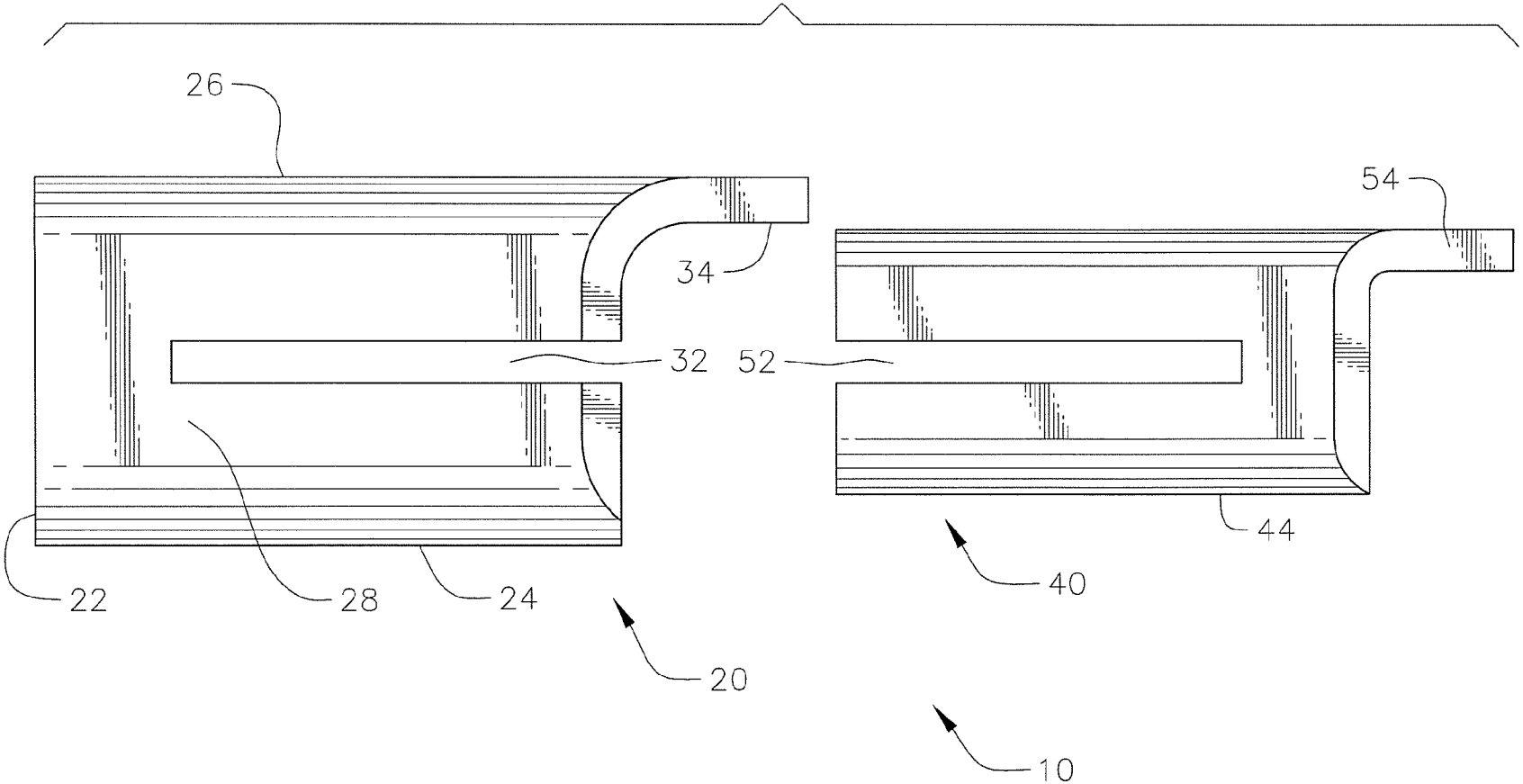
FIG. 4 is a side view of the theft prevention device of FIG. 1.
Figure 5:
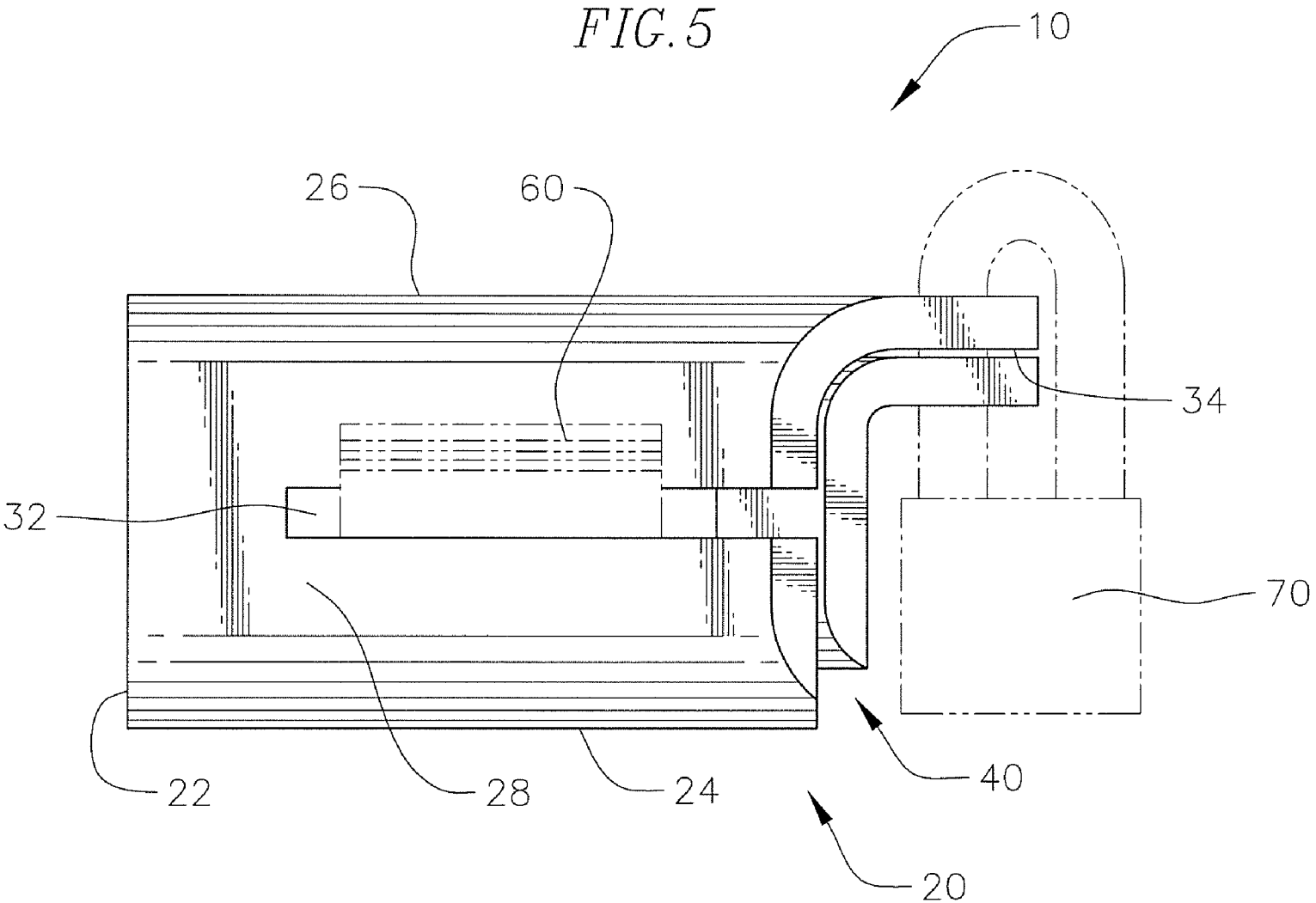
FIG. 5 is a side view theft prevention device of FIG. 1 that has been coupled and locked.

With specific reference to FIG. 4, the top wall 26 defines a ledge 34 protruding past an edge of the side wall 28. The ledge has an outer shell opening 36 adapted to receive a lock 70 (FIG. 5) for locking the outer shell to the inner shell, as described below. The ledge 34 extends past the end of the side walls 28 and the bottom wall 24 by a sufficient distance such that when the lock 70 is inserted through the opening 36, the side walls and the bottom wall do not interfere with the lock.

The inner shell 40 is sized to fit within the outer shell 20 and may be made of the same or a substantially similar material as the outer shell. Similarly to the outer shell 20, the inner shell includes an end wall 42, a bottom wall 44, a top wall 46 and side walls 48. Together, the walls 42, 44, 46, 48 define an inner shell cavity 50 dimensioned to cover a buckle of a strap. As will be appreciated, the size of the inner shell 40 may be dimensioned to fit over differently sized buckles, depending on the desired use. As with the outer shell 20, the inner shell 40 is a single integral structure, but it will be appreciated that the inner shell 40 may also be made from separate pieces that are attached together, such as by welding or by fasteners.

Each of the side walls 48 includes a slit 52 sized to allow a strap 60 to pass therethrough when the theft prevention device covers a buckle. In one embodiment, the slit 52 is wide enough to allow the strap 60 to pass therethrough, but not so wide as to allow access to the buckle such that the buckle could be uncoupled. The slit 52 has an open end at the termination of the side wall 48 opposite the end wall 42 to allow the strap to be inserted into the slit. Additionally, in one embodiment, the slit 52 does not extend along the entire length of the side wall 48, thereby preventing the inner shell 40 from being able to slide off a lateral edge of the strap 60.

Again with specific reference to FIG. 4, the top wall 46 of the inner shell 40 defines a ledge 54 protruding past the end wall 44. The ledge 54 has an inner shell opening 56 adapted to receive the lock 70 (FIG. 5) for locking the inner shell to the outer shell. The ledge 54 extends past the end of the side walls 48 and the bottom wall 44 by a sufficient distance such that when the lock 70 is inserted through the opening 56, the side walls and the bottom wall do not interfere with the lock.

Operation of the theft prevention device will now be described with respect to FIGS. 1-5. First, the outer shell 20 is laterally slid over the strap so as to generally cover the buckle or other desired area and so that the strap extends out from the outer shell through the outer shell slits 32 on each of the side walls 28. Then the inner shell 40 is mated with the outer shell 20 by being inserted into the cavity 30 of the outer shell such that strap extends from the inner shell slits 52 and such that together the inner shell and the outer shell encompass the buckle of the strap.

The inner shell 40 is inserted into the outer shell 20 such that the inner shell opening 56 is substantially aligned with the outer shell opening 36, i.e., the end wall 44 of the inner shell is opposite to the end wall 22 of the outer shell 20. When the openings 35, 56 are substantially aligned, the lock 70 (FIG. 3) can be inserted through the openings and locked to prevent the inner shell 40 from being uncoupled from the outer shell 20, thereby preventing undesired uncoupling of the buckle and access to the contents within the storage unit. As will be understood, once the lock is removed from the openings 35, 56, the inner shell 40 can be separated from the outer shell 20 to expose the buckle.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A theft prevention device comprising:

an outer shell having a top wall and side walls and defining a cavity, wherein the side walls have a slit therein adapted to accommodate a strap and wherein the top wall has an outer shell opening; and an inner shell having a top wall and side walls and defining a cavity, wherein the side walls have a slit therein adapted to accommodate a strap and wherein the top wall as an inner shell opening; wherein the inner shell is adapted to be mated to the outer shell such that the inner shell opening and the outer shell opening can be generally aligned and wherein the top wall of the inner shell is covered by the top wall of the outer shell such that an exterior-facing surface of the top wall of the inner shell is adjacent to an interior-facing surface of the top wall of the outer shell.

2. The theft prevention device of claim 1, wherein the top walls of the outer shell and of the inner shell define a ledge which protrudes past an end of the side walls of the outer shell and of the inner shell, respectively, and wherein the outer shell opening and the inner shell opening are located on the ledge of the outer shell and the inner shell, respectively.

3. The theft prevention device of claim 1, wherein when the inner shell is mated with the outer shell, the slits on the inner shell and the outer shell overlap and are substantially aligned.

4. The theft prevention device of claim 1, wherein the inner shell and the outer shell each further comprise a bottom wall opposite to the top wall and an end wall extending between the side walls and between the top wall and the bottom wall, wherein when the inner shell is mated with the outer shell, the end wall of the inner shell is opposite to the end wall of the outer shell.

5. The theft prevention device of claim 1, wherein when the inner shell is mated with the outer shell, the theft prevention device defines a space therein adapted to accommodate a buckle attached to a strap.

6. The theft prevention device of claim 1, wherein the inner shell and the outer shell comprise metal or a polymer resin.

7. The theft prevention device of claim 1, further comprising a lock, wherein when the inner shell is mated with the outer shell and when the lock is inserted through the inner shell opening and the outer shell opening, the inner shell is prevented from being separated from the outer shell.

8. The theft prevention device of claim 1, wherein the outer shell is a single integral component.

9. The theft prevention device of claim 1, wherein the inner shell is a single integral component.

* * * * *

UNITED STATES PATENT AND TRADEMARK OFFICE

CERTIFICATE OF CORRECTION

PATENT NO. : 8,037,723 B2
APPLICATION NO. : 12/709363
DATED : October 18, 2011
INVENTOR(S) : Gary Fong It is certified that error appears in the above-identified patent and that said Letters Patent is hereby corrected as shown below:

In the Claims

Column 4, Claim 1, line 14. Delete "as"
Insert -- has --

Signed and Sealed this
Third Day of July, 2012

David J. Kappos

David J. Kappos
*Director of the United States Patent and Trademark Office*